US011859268B2

(12) United States Patent
Aguirre et al.

(10) Patent No.: US 11,859,268 B2
(45) Date of Patent: Jan. 2, 2024

(54) DISSOLVABLE MAGNESIUM ALLOY

(71) Applicant: YPF TECNOLOGÍA S.A., Ciudad Autónoma de Buenos Aires (AR)

(72) Inventors: Luis Alberto Aguirre, Buenos Aires (AR); Reynaldo Martin Romero, La Plata Pcia. de Buenos Aires (AR); Walter Morris, Neuquén (AR)

(73) Assignee: YPF TECNOLOGIA S.A., Ciudad Autonoma de Buenos Aires (AR)

( * ) Notice: Subject to any disclaimer, the term of this patent is extended or adjusted under 35 U.S.C. 154(b) by 0 days.

(21) Appl. No.: 17/943,961

(22) Filed: Sep. 13, 2022

(65) Prior Publication Data

US 2023/0080114 A1 Mar. 16, 2023

Related U.S. Application Data

(60) Provisional application No. 63/243,315, filed on Sep. 13, 2021.

(51) Int. Cl.
*C22C 23/02* (2006.01)

(52) U.S. Cl.
CPC ..... *C22C 23/02* (2013.01)

(58) Field of Classification Search
CPC ..... C22C 23/02; C22F 1/06
See application file for complete search history.

(56) References Cited

U.S. PATENT DOCUMENTS

| | | | | |
|---|---|---|---|---|
| 5,906,689 | A | 5/1999 | Sircar | |
| 6,302,973 | B1 | 10/2001 | Haszler et al. | |
| 6,416,884 | B1 | 7/2002 | Haszler et al. | |
| 2001/0025675 | A1 | 10/2001 | Haszler et al. | |
| 2010/0089506 | A1 | 4/2010 | Trenda | |
| 2014/0030141 | A1 | 1/2014 | Asteman et al. | |
| 2016/0263288 | A1* | 9/2016 | Edick | A61F 2/04 |

FOREIGN PATENT DOCUMENTS

| | | | | |
|---|---|---|---|---|
| WO | WO 2016/032490 | A1 | 3/2016 | |
| WO | WO-2016032758 | A1 * | 3/2016 | C22C 21/02 |
| WO | WO 2017/086955 | A1 | 5/2017 | |

OTHER PUBLICATIONS

Foseco Non-Ferrous Foundryman's Handbook Eleventh edition Revised and edited by John R. Brown, 313 pages, Eleventh Edition 1999, Butterworth-Heinemann, Oxford.

You, Sihang et al. "Recent research and developments on wrought magnesium alloys," Journal of Magnesium and Alloys Sep. 28, 2017, pp. 239-253, vol. 5, Issue 3.

Karakulak, Erdem, "A review: Past, present and future of grain refining of magnesium castings," Journal of Magnesium and Alloys, Jun. 1, 2019, pp. 355-369, vol. 7, Issue 3.

Lee, Y.C. et al., "The Role of Solute in Grain Refinement of Magnesium," Metallurgical and Materials Transactions A, Nov. 2000, pp. 2897-2906, vol. 31A.

Dahle, Arne K. et al., "Development of the as-cast microstructure in magnesium-aluminium alloys," Journal of Light Metals, Feb. 2001, pp. 61-72, vol. 1, Issue 1, Elsevier Science Ltd.

Mordike, Barry L., et al. Magnesium Technology—Metallurgy Design Data and Applications, 433 pages pp. 79-84 of Chapter 3—Physical Metallurgy, pp. 109-121 of Chapter 4—Melting, Alloying and Refining, pp. 145-162 of Chapter 5—Magnesium Casting Alloys, pp. 219-233 of Chapter 6—Technology of Magnesium and Magnesium Alloys, pp. 469-494 of Chapter 7—Corrosion and Surface Protections.

Padfield, T.V. et al., "Metallography and Microstructures of Magnesium and Its Alloys," Automotive of America—ASM Handbook, vol. 9—Metallography and Microstructures, 2004, pp. 801-815, ASM International.

Beer, A. G., "Enhancing the extrudability of wrought magnesium alloys," Chapter 8 Advances in wrought magnesium alloys, 2012, pp. 304-322, Deakin University, Australia, Woodhead Publishing Limited.

Neelameggham, Neale R., "Part 3: Melting, Refining, Recycling, And Life-Cycle Analysis", Essential Readings in Magnesium Technology Feb. 2014, pp. 133-134.

Zhang, Yaoxian et al, "Segregation Behavior and Evolution Mechanism of Iron-Rich Phases in Molten Magnesium Alloys," Journal of Materials Science & Technology, Jan. 2016, pp. 48-53, vol. 32, Issue 1.

Cashion, S. et al., "The Use Of $S0_2$ As A Cover Gas For Molten Magnesium," CRC for Alloy and Solidification Technology (CAST), Magnesium Technology, 2000, pp. 77-81, The Minerals, Metals & Materials Society, 2000.

Du, B.D. et al., "Al-water reactivity of Al—Mg—Ga—In—Sn alloys used for hydraulic fracturing tools," International Journal of Hydrogen Energy, Apr. 12, 2018, pp. 7201-7215, vol. 43, Issue 15, Elsevier Ltd.

* cited by examiner

*Primary Examiner* — Jessee R Roe
(74) *Attorney, Agent, or Firm* — Muncy, Geissler, Olds & Lowe, P.C.

(57) ABSTRACT

A dissolvable alloy, the chemical composition of which comprises aluminum between 2.5% and 9%; zinc between 0.1% and 1.5%; iron between 0.01% and 3%; and magnesium the remainder, such alloy being usable in tools and components of the petroleum industry.

7 Claims, 2 Drawing Sheets

DISSOLVABLE MAGNESIUM ALLOY

FIELD OF THE INVENTION

The present invention relates to the area of metal alloys. More particularly, the present invention relates to a dissolvable magnesium alloy usable in tools and components of the petroleum industry.

BACKGROUND OF THE INVENTION

There are a large number of documents in the prior art related to dissolvable metal alloys, including those described in patent documents WO 2016/032490 A1 and WO 2017/086955 A1.

In particular, patent application WO 2016/032490 A1 is directed to a downhole tool comprising at least one component made of a doped alloy at least partially degradable by microgalvanic corrosion, said doped alloy being selected from the group consisting of a doped magnesium alloy, a doped aluminum alloy, and any combination thereof.

Patent application WO 2017/086955 A1 is directed to a downhole tool comprising a degradable material. This degradable material may include at least one of aluminum alloy, magnesium alloy, zinc alloy, bismuth alloy, tin alloy, or any combination thereof.

None of documents WO 2016/032490 A1 and WO 2017/086955 A1 describe the use of as-cast alloys which imply a considerable cost advantage as such alloys do not have to undergo hot plastic deformation processes and/or heat treatments to improve their mechanical properties.

Consequently, there is a need to provide a dissolvable alloy that can be used as cast in tools and components of the petroleum industry.

BRIEF DESCRIPTION OF THE INVENTION

Based on the above considerations, the present invention provides a dissolvable magnesium-based alloy which permits its use as cast in tools and components of the petroleum industry.

Consequently, an object of the present invention is a dissolvable alloy, the chemical composition of which comprises:

aluminum between 2.5% and 9%;
zinc between 0.1% and 1.5%;
iron between 0.01% and 3%; and
magnesium the remainder.

In a preferred embodiment of the present invention, said alloy further comprises copper between 0.2% and 4.1%.

In an embodiment of the present invention, said alloy is dissolvable in fresh water and in formation water of the oil wells.

In a preferred embodiment of the present invention, said alloy is dissolvable at 55° C. and above.

In a preferred embodiment of the present invention, the dissolvable alloy is obtained by means of a casting process and is used as cast.

In a preferred embodiment of the present invention, said alloy is subjected to grain refinement by incorporating an inoculating agent, preferably, calcium silicide.

In an embodiment of the present invention, said dissolvable alloy is in the form of bars.

In an embodiment of the present invention, said dissolvable alloy is used to make oil well tools and components, preferably, to make disposable plugs for hydraulic testing.

DETAILED DESCRIPTION OF THE INVENTION

Figure 1:
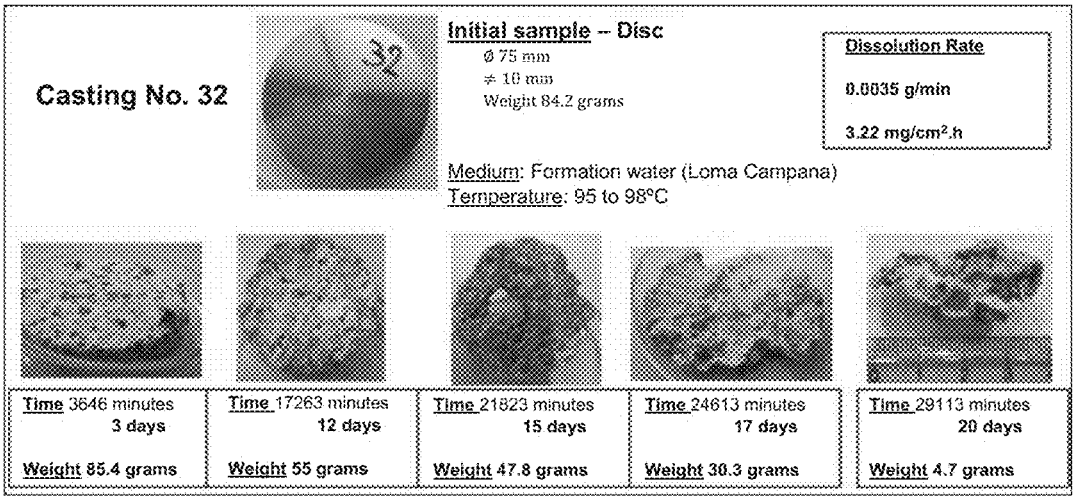
FIG. 1 shows the results of a dissolvability test of a sample in synthetic formation water.

For the purposes of the present invention, it is to be understood that the percentages of the components of the dissolvable alloy of the present invention refer to percentages by weight of the total composition of said dissolvable alloy. Thus, and by way of example, when it is indicated that the dissolvable alloy comprises a component between 2.5% and 9%, it is to be understood that said component may represent between 2.5% and 9% of the total weight of the dissolvable alloy.

In an embodiment of the dissolvable alloy of the present invention, the dissolvable alloy comprises magnesium between 86.5% and 97.39%; aluminum between 2.5% and 9%; zinc between 0.1% and 1.5%; and iron between 0.01% and 3%.

In a preferred embodiment of the dissolvable alloy of the present invention, the dissolvable alloy comprises magnesium between 87.5% and 95.9%; aluminum between 3% and 8%; zinc between 0.1% and 1.5%; and iron between 1% and 3%.

In a preferred embodiment of the dissolvable alloy of the present invention, the dissolvable alloy comprises magnesium between 82.4% and 97.19%, aluminum between 2.5% and 9%, zinc between 0.1% and 1.5%, iron between 0.01% and 3% and copper between 0.2% and 4.1%.

The dissolvable alloy of the present invention is obtained by means of a casting process and is presented in the form of bars, such as solid bars of circular, square, rectangular, hexagonal cross section, among others.

In said dissolvable alloy, magnesium is the base chemical element, wherein aluminum increases mechanical strength by dissolvability in magnesium, and wherein iron and copper generate in the base microstructure of the alloy a nobler electrochemical potential in the matrix, with respect to an alloy comprising only magnesium and aluminum. This generates a galvanic microcorrosion, allowing the dissolvability of the dissolvable alloy of the present invention.

In addition, zinc increases the mechanical characteristics of the dissolvable alloy of the present invention and copper contributes to the dissolvability of iron.

The fact that the dissolvable alloy comprises aluminum makes it necessary, during the casting process, to add an inoculating agent, preferably calcium silicide, which allows a grain refinement of the dissolvable alloy, once it solidifies. In particular, such grain refinement allows the dissolvable alloy to have a microstructure with a fine grain size, which significantly improves the mechanical properties in the as-cast condition.

In this way, the dissolvable alloy of the present invention can be used as it is obtained from the casting process, without being necessary a hot plastic deformation process, for example, hot rolling or hot extrusion, which allows to improve its mechanical properties, such as mechanical strength. Likewise, it is not necessary for the dissolvable alloy of the present invention to be subjected to a heat treatment.

The dissolvable alloy of the present invention is dissolvable in both fresh water and formation water at temperatures of 55° C. and above.

Accordingly, the dissolvable alloy of the present invention can be used in tools and elements for carrying out various operations in oil wells.

In a preferred way of using the dissolvable alloy of the present invention, it is used to make dissolvable hydraulic fracturing and stimulation plugs for Plug&Perf and production operations in both unconventional wells and conventional wells. Additionally, said dissolvable alloy can be used to make disposable plugs for hydraulic testing.

Dissolvable plugs made from the dissolvable alloy of the present invention have 100% dissolvability when subjected to both the temperature conditions within the wellbore and the fluids therein. Preferably, a plug made from the dissolvable alloy of the present invention has a dissolvability time starting at 48 hours and can exceed 30 days.

In this way of use, the dissolvable alloy allows for the tightness of the seal made by the plug for a certain amount of time lasting, for example, a hydraulic testing process such as hydraulic fracturing. Once the plug withstands hydraulic fracturing pressures, it dissolves and the oil well can be put on production without the plug offering any resistance to the flow of production fluids.

The manufacture of the dissolvable alloy of the present invention comprises the melting of its chemical components, aggregated as combined raw materials, in a crucible of a gas and/or electric furnace.

In this melting process, argon gas is blown in for a period sufficient to degas and homogenize the alloy, the surface of which is further protected from the ambience by means of a solid covering flux.

Experimental Results

Below, dissolvability tests carried out with the dissolvable alloy of the present invention are described. These tests consisted of placing samples of the dissolvable alloy in glass beaker with one of the following fluids (i) formation water according to chromatography from each well where the corresponding chromatography tests were carried out, (ii) 0.1% w/v (weight/volume) Potassium Chloride (KCl) aqueous solution, and (iii) tap water (non-potable) to evaluate its degree of susceptibility to corrosion; and then heating the beaker to a temperature between 95° C. and 98° C. in some tests, and between 55° C. and 58° C. in other tests.

It should be noted that the dissolvable alloy samples tested had different chemical compositions, these chemical compositions comprising aluminum between 2.5% and 9%; zinc between 0.10% and 1.5%; iron between 0.010% and 3%; and magnesium the remainder; and in the case of the dissolvable alloy samples that also included copper, the chemical composition of these samples comprised magnesium between 82.4% and 97.19%, aluminum between 2.5% and 9%, zinc between 0.10% and 1.5%, iron between 0.01% and 3% and copper between 0.2% and 4.1%.

Some of the samples used had a diameter of approximately 70 mm and a thickness of approximately 10 mm, and were pre-weighed. Thus, at intervals of, for example, 24 hours, 48 hours and 72 hours, the weight of the final sample was evaluated and its dissolution rate was determined in the following units, gr/minute and then passed to mg/cm2·hour.

At the beginning of each test day, the fluid in the glass beaker was replaced with a new one in order to avoid the generation of compounds that would passivate the surface of the tested sample.

The formation water used in the tests was designed based on results obtained from chromatography tests that were taken from water of the oil wells, specifically, it was designed based on those waters that presented a higher degree of corrosion.

Table 1 shows the composition of a first formation water that was designed and used in some of the tests, wherein said first formation water is "synthetic" formation water equivalent to the water of the reservoir of Loma Campana, province of Neuquen, Argentina. In particular, for this water, sodium bicarbonate, which was part of the original composition of the water of that reservoir, was replaced by sodium chloride to avoid precipitation of salts.

TABLE 1

"Synthetic" formation water equivalent to the water of the reservoir of Loma Campana

| Salts | grams/liter |
|---|---|
| $Cl_2Ca$ | 75.5 |
| $Cl_2Mg \cdot 6H_2O$ | 24.3 |
| $SO_4Na$ | 0.32 |
| NaCl | 60.8 |

The final total dissolved solids (TDS) are 147269.6 ppm (parts per million), defining the amount of salts in the formation water solution.

Table 2 shows the composition of a second formation water that was designed and used in some tests, wherein said second formation water is "synthetic" formation water equivalent to the water of the reservoir of Grimbeek, province of Chubut, Argentina. In particular, the tests with this second formation water were carried out at an average temperature of 55° C., which corresponds to the temperature of the wells in this reservoir, which have an average depth of 1100 m.

TABLE 2

"Synthetic" formation water equivalent to the water of the reservoir of Grimbeek

| Salts | grams/liter |
|---|---|
| $CaCl_2$—$2H_2O$ | 0.220 |
| $MgCl_2 \cdot 6H_2O$ | 0.133 |
| $SO_4Na$ | 0.002 |
| ClNa | 9.841 |
| $NaHCO_3$ | 3.443 |

It should be noted that the Grimbeek reservoir water has a high amount of bicarbonate so when designing the second formation water shown in Table 2 approximately 20% of the bicarbonate was removed so as not to change the nature of the water and to avoid, or at least minimize, the appearance of precipitate.

In some tests with the second formation water, machined covers, for the assembly of Shear Out plugs, of the dissolvable alloy of the present invention, whose dimensions were a diameter of 64 mm, and a thickness of 34 mm, with an average weight of 200 g, were used as samples.

Below, Table 3 shows results of dissolvability tests in formation water where the sample was heated to a temperature between 95° C. and 98° C. It should be understood that the numbers (No.) of castings shown in said Table 3 correspond to a sample made from the dissolvable alloy obtained from that given number of casting.

TABLE 3

Dissolvability tests in formation water at T° >95° C.

| Casting | Weight | | Final Time | Dissolvability Rate | | | |
|---|---|---|---|---|---|---|---|
| No. | Initial | Final | Hs | % | Dissolution Rate | Fluid used | Test observations |
| 24 | 71.6 g | 0.0 g | 22.13 | 100% | 0.0540 g/min<br>31.30 mg/cm2 · hr | Synthetic formation water equivalent to the Loma Campana (LC) reservoir. | At 280 minutes after starting the test, the water is changed and the sample is weighed (wet) giving a value of 44.01252 g (dissolution rate of approximately 0.1 g/min). The final time is taken as the time when it was observed that the sample was already dissolved. |
| 25 | 87.4 g | 81.3 g | 103.45 | 7% | 0.0010 g/min<br>0.57 mg/cm2 · hr | Synthetic formation water equivalent to the Loma Campana (LC) reservoir. | — |
| 26 | 88.2 g | 46.4 g | 72.77 | 47% | 0.0096 g/min<br>5.41 mg/cm2 · hr | Synthetic formation water equivalent to the Loma Campana (LC) reservoir. | At 360 minutes after starting the test, the sample increased in mass (89.9 g). Then, it began to decrease its mass until the final weight/Disc diameter 7.1 cm/Thickness 12.1 mm. |
| 27 | | | | | Not carried out | | It was not carried out due to the number of defects in the piece. Approximately 40 defects >1 mm. |
| 28 | 74.1 g | 73.1 g | 8 | 1% | 0.0021 g/min<br>1.24 mg/cm2 · hr | 0.1% KCl | Disc diameter 7 cm/Thickness 1.1 cm. |
| | 73.3 g | 63.4 g | 72.7 | 14% | 0.0023 g/min<br>1.45 mg/cm2 · hr | Synthetic formation water equivalent to the Loma Campana (LC) reservoir. | At 600 min from starting the test the sample increased its mass, then, it began to decrease its mass until the final weight/Disc diameter 68 mm/Thickness 1 mm. |
| 29 | 75.7 g | 73.2 g | 8 | 3% | 0.0052 g/min<br>3.16 mg/cm2 · hr | 0.1% KCl | — |
| | 71.8 | 0.0 g | 22.5 | 100% | 0.0532 g/min<br>32.25 mg/cm2 · hr | Synthetic formation water equivalent to the Loma Campana (LC) reservoir. | Disc diameter 70 mm/ Thickness 10 mm. |
| 31 | 88.8 g | 65.6 g | 109 | 26.10% | 0.0035 g/min<br>2.06 mg/cm2 · hr | Synthetic formation water equivalent to the Loma Campana (LC) reservoir. | Disc diameter 70 mm/ Thickness 12 mm. |
| 32 | 84.2 g | 82.4 g | 109.8 | 2.20% | 0.0035 g/min<br>3.22 mg/cm2 · hr | Synthetic formation water equivalent to the Loma Campana (LC) reservoir. | Disc diameter 75 mm/ Thickness 10 mm. |
| 33 | 200.6 g | 0.0 g | 403.3 | 100% | 0.0083 g/min<br>3.45 mg/cm2 · hr | Synthetic formation water equivalent to the Loma Campana (LC) reservoir. | Disc diameter 68 mm/ Thickness 33.5 mm. |
| 34 | | | | | No se realizó | | |
| 35 | 86.9 g | 0.0 g | 47.43 | 100% | 0.0310 g/min<br>17.72 mg/cm2 · hr | Synthetic formation water equivalent to the Loma Campana (LC) reservoir. | Disc diameter 70 mm/ Thickness 12 mm. |
| 36 | 87.9 g | 2.7 g | 168.3 | 96.877% | 0.0084 g/min<br>4.66 mg/cm2 · hr | Synthetic formation water equivalent to the Loma Campana (LC) reservoir. | Disc diameter 72 mm/ Thickness 12 mm. |

Table 4 below shows results of dissolvability tests in 0.1% KCl where the sample was heated to a temperature between 95° C. and 98° C.

TABLE 4

Dissolvability tests in 0.1% KCl at T° >95° C.

| Casting | Weight | | Final Time | Dissolvability Rate | | | |
|---|---|---|---|---|---|---|---|
| No. | Initial | Final | Hs | % | Dissolution Rate | Fluid used | Test observations |
| 31 | 89.1 g | 88.2 g | 8 | 1% | 0.0019 g/min<br>1.09 mg/cm2 · hr | 0.1% KCl | Disc diameter 70 mm/Thickness 12 mm. |
| 32 | 83.4 g | 82.6 g | 7 | 1% | 0.0018 g/min<br>1.00 mg/cm2 · hr | 0.1% KCl | Disc diameter 75 mm/Thickness 11 mm. |
| 35 | 62.8 g | 61.1 g | 5 | 3% | 0.0058 g/min<br>8.12 mg/cm2 · hr | 0.1% KCl | The disc is incomplete - Disc diameter 70 mm/Thickness 12 mm. |
| 36 | 88.5 g | 88.2 g | 8 | 0.38% | 0.0007 g/min<br>0.35 mg/cm2 · hr | 0.1% KCl | Disc diameter 70 mm/Thickness 13 mm. |

Table 5 below describes the chemical composition of each of the castings and, consequently, of the samples made from the dissolvable alloy obtained from these castings.

TABLE 5

Chemical composition of the castings.

| No. of casting | Magnesium | Aluminum | Zinc | Iron | Copper |
|---|---|---|---|---|---|
| 24 | Balance | 2.5% | 0.28% | 0.096% | Not added |
| 25 | Balance | 6.6% | 0.98% | 0.050% | Not added |
| 26 | Balance | 8.0% | 0,88% | 0.12% | Not added |
| 27 | Balance | 6.7% | 0.90% | 0.13% | 0.60% |
| 28 | Balance | 5.1% | 0.78% | 0.10% | 0.58% |
| 29 | Balance | 5.0% | 0.65% | 0.18% | 1.74% |
| 31 | Balance | 4,8% | 0.79% | 0.17% | 4.10% |
| 32 | Balance | 7.1% | 0.61% | 0.090% | 0.45% |
| 33 | Balance | 7.9% | 0.75% | 0.080% | 0.33% |
| 34 | Balance | 8.9% | 0.86% | 0.12% | 1.30% |
| 35 | Balance | 5.3% | 0,13% | 0.08% | 1.91% |
| 36 | Balance | 8.1% | 1.28% | 0.11% | 0.54% |

Referring to FIG. 1, this shows the results of the dissolvability test of the casting 32 of Table 3, wherein in the upper part of said FIG. 1 there is a photo of the disc-shaped sample, and data thereof, used in said dissolvability test before being tested, and in the lower part of said FIG. 1 there are several photos showing the state of the tested sample at different times during the test. In particular, there are shown in the lower part a photo corresponding to the state of the sample after 3 days of exposure to the equivalent "synthetic" formation water of Loma Campana and at a temperature between 95° C. and 98° C.; a photo corresponding to the state of the sample after 12 days of exposure to the equivalent "synthetic" formation water of Loma Campana and at a temperature between 95° C. and 98° C.; a photo corresponding to the state of the sample after 15 days of exposure to the equivalent "synthetic" formation water of Loma Campana and at a temperature between 95° C. and 98° C.; a photo corresponding to the state of the sample after 17 days of exposure to the equivalent "synthetic" formation water of Loma Campana and at a temperature between 95° C. and 98° C.; a photo corresponding to the state of the sample after 20 days of exposure to the equivalent "synthetic" formation water of Loma Campana and at a temperature between 95° C. and 98° C., also showing the corresponding weight of the sample at each given moment, thus showing a dissolution rate of 0.0035 g/min or 3.22 mg/cm2·hr.

Figure 2:
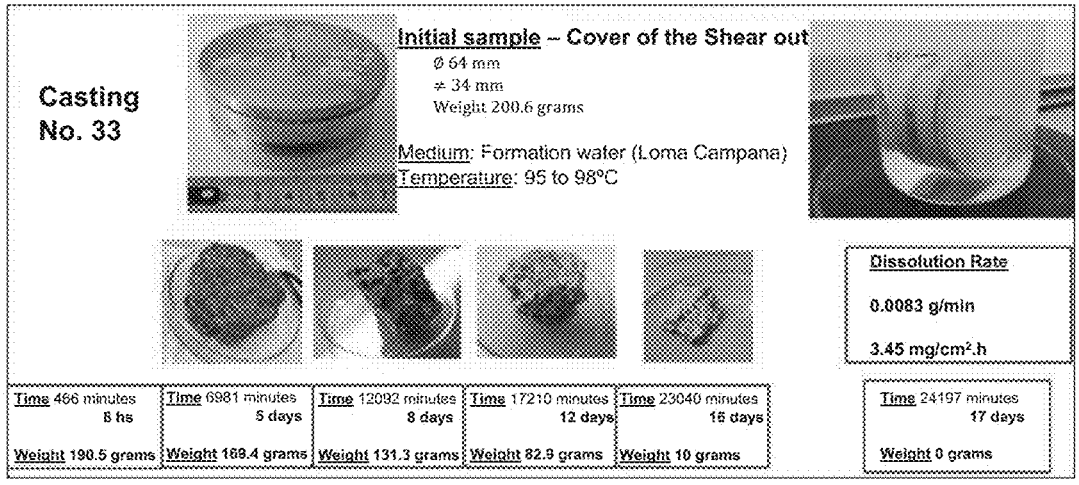
FIG. 2 shows the results of a dissolvability test of a sample in synthetic formation water.

Referring to FIG. 2, this shows the results of the dissolvability test of casting 33 of Table 3, wherein in the upper part of FIG. 2 there is a photo of the sample in the form of a Shear Out plug cover, and data thereof, used in said dissolvability test before being tested, and in the lower part of FIG. 2 there are several photos showing the state of the tested sample at different times during the test. In particular, there are shown in the lower part shows the results of the sample after 8 hours of exposure to the equivalent "synthetic" formation water of Loma Campana and at a temperature of between 95° C. and 98° C.; a photo corresponding to the state of the sample after 5 days of exposure to the equivalent "synthetic" formation water of Loma Campana at a temperature between 95° C. and 98° C.; a photo corresponding to the state of the sample after 8 days of exposure to the equivalent "synthetic" formation water of Loma Campana at a temperature between 95° C. and 98° C.; a photo corresponding to the state of the sample after 12 days of exposure to the equivalent "synthetic" formation water of Loma Campana (LC) at a temperature between 95° C. and 98° C.; a photo corresponding to the state of the sample after 16 days of exposure to the equivalent "synthetic" formation water of Loma Campana (LC) and at a temperature between 95° C. and 98° C.; and the results of the sample after 17 days of exposure to the equivalent "synthetic" formation water of Loma Campana at a temperature between 95° C. and 98° C., showing the corresponding weight of the sample at each given time, thus evidencing a dissolution rate of 0.0083 g/min or 3.45 mg/cm2·hr, and the complete dissolution of the sample after 17 days.

Figure 3:
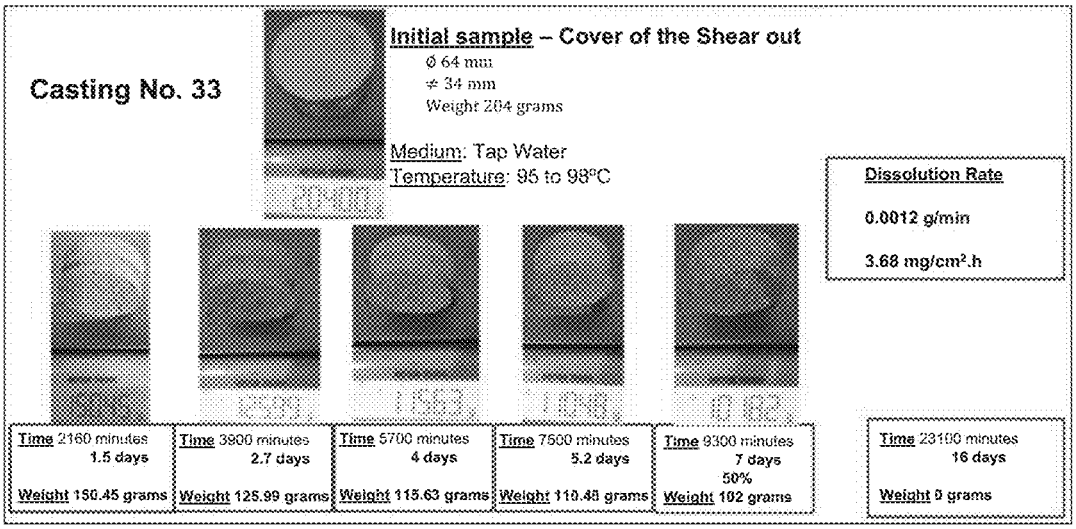
FIG. 3 shows the results of a dissolvability test of a sample in tap water.

Referring to FIG. 3, this shows the results of the dissolvability test of casting 33, wherein in the upper part of FIG. 3 there is a photo of the sample in the form of a Shear Out plug cover, and data thereof, used in the dissolvability test before being tested, and in the lower part of FIG. 3 there are several photos showing the state of the tested sample at different times during the test. In particular, there are shown a photo corresponding to the state of the sample after being 1.5 days exposed to tap water and at a temperature of 95° C. and 98° C.; a photo corresponding to the state of the sample after being 2.7 days exposed to tap water and at a temperature of 95° C. and 98° C.; a photo corresponding to the state of the sample after being 4 days exposed to tap water and at a temperature of 95° C. and 98° C.; a photo corresponding to the state of the sample after 5.2 days of exposure to tap water at a temperature of 95° C. and 98° C.; a photo corresponding to the state of the sample after 7 days of exposure to tap water at a temperature of 95° C. and 98° C.; and the results of the sample after 16 days of exposure to tap water at a temperature of 95° C. and 98° C., showing the corresponding weight of the specimen at each given time, thus evidencing a dissolution rate of 0.0012 g/min or 3.68 mg/cm2·hr, and the complete dissolution of the test tube after 16 days.

Figure 4:
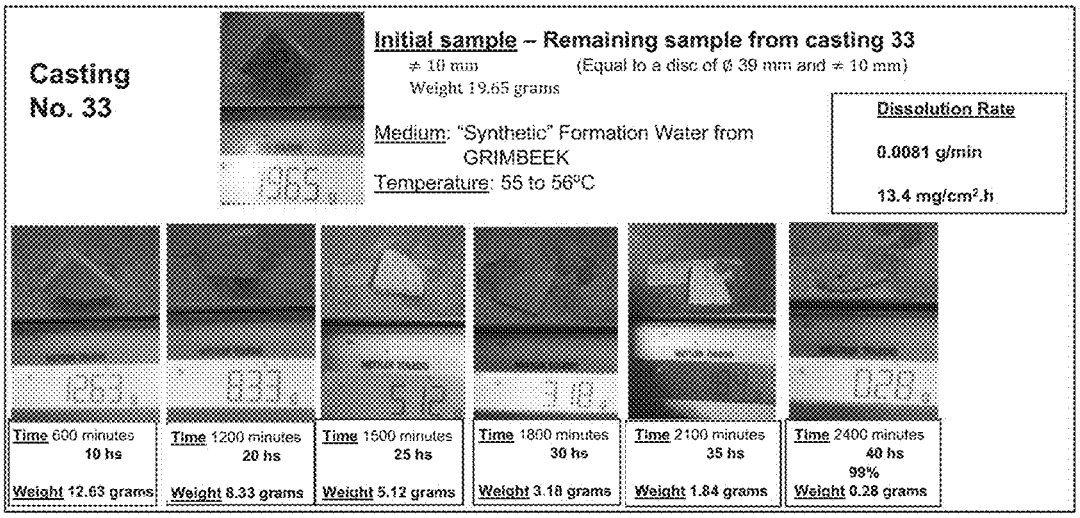
FIG. 4 shows the results of a dissolvability test of a sample in synthetic formation water.

Referring to FIG. 4, this shows the results of the dissolvability test of casting 33, wherein in the upper part of FIG. 4 there is a photo of the sample, and data thereof, used in said dissolvability test before being tested, and in the lower part of FIG. 4 there are several photos showing the state of the tested sample at different times during the test. In particular, there are shown a photo corresponding to the state of the specimen after 10 hours of exposure to the equivalent "synthetic" formation water of Grimbeek at a temperature of between 55° C. and 56° C.; a photo corresponding to the state of the sample after 20 hours of exposure to equivalent "synthetic" formation water at a temperature between 55° C. and 56° C.; a photo corresponding to the state of the sample after 25 hours of exposure to the equivalent "synthetic" formation water of Grimbeek at a temperature between 55° C. and 56° C.; a photo corresponding to the state of the sample after 30 hours of exposure to equivalent "synthetic" formation water of Grimbeek at a temperature between 55° C. and 56° C.; a photo corresponding to the state of the sample after 35 hours of exposure to equivalent "synthetic" formation water of Grimbeek at a temperature between 55° C. and 56° C.; a photo corresponding to the state of the sample after 40 hours of exposure to equivalent "synthetic" formation water of Grimbeek at a temperature between 55° C. and 56° C., showing the corresponding weight of the specimen at each given time, thus evidencing a dissolution rate of 0.0081 g/min or 13.4 mg/cm2·hr, and the almost complete (99%) dissolution of the sample at 40 hours.

For each sample tested, dissimilar dissolubilities were observed, as a result of the modifications of the process parameters such as the fluid used and the temperature, and the characteristics of the specimens.

The results defined as suitable for the manufacture of disposable plugs for hydraulic tests or Shear Out Plug, considering the Formation Water of Loma Campana (LC), were from 3.22 mg/cm2·hour to 17.72 mg/cm2·hour (0.0035 g/min to 0.0310 g/min). It should be understood that the variation of the dissolution rate is due to the fact that such dissolution rate depends on the chemical composition of the dissolvable alloy of the tested sample, and therefore, depending on the value of such chemical composition, it can have a low or high dissolution rate.

Table 6 below shows estimates of the dissolvability of a sample equivalent to the weight of a Shear Out plug cover of approximately 200 g, carried out in Synthetic Formation Water of Loma Campana (LC) and at a temperature between 95° C. and 98°.

TABLE 6

Estimated dissolvability in LC synthetic water at T° > 95° C. for a mass of 200 g.

| Casting 31 | Casting 32 | Casting 33 | Casting 35 | Casting 36 |
|---|---|---|---|---|
| 0.0035 g/min | 0.0035 g/min | 0.0083 g/min | 0.0310 g/min | 0.0084 g/min |
| 2.06 mg/cm2 · hr | 3.22 mg/cm2 · hr | 3.45 mg/cm2 · hr | 17.72 mg/cm2 · hr | 4.6600 mg/cm2 · hr |
| 57143 min | 57143 min | 24096 min | 6452 min | 23810 min |
| 40 days | 40 days | 17 days | 4 days | 17 days |

It can be concluded, from the estimation obtained in Table 6, that the minimum and maximum dissolvability values for the cover made of the dissolvable alloy of the present invention, lies between 17 days and 40 days, particularly, between 0.0035 g/min and 0.0083 g/min, or between 3.22 $mg/cm^2 \cdot h$ and 3.45 $mg/cm^2 \cdot h$.

The invention claimed is:

1. A dissolvable alloy, the chemical composition of which comprises:

aluminum between 2.5% and 9% by weight;

zinc between 0.1% and 1.5% by weight;

iron between 0.01% and 3% by weight; and magnesium the remainder, wherein said dissolvable alloy is obtained by means of a casting process, and wherein in said casting process the dissolvable alloy is subjected to grain refinement by incorporating calcium silicide as an inoculating agent.

2. The dissolvable alloy according to claim 1, further comprising copper between 0.2% and 4.1% by weight.

3. The dissolvable alloy according to claim 1, wherein said alloy is dissolvable in fresh water and in formation water of the oil wells.

4. The dissolvable alloy according to claim 1, wherein said alloy is dissolvable at 55° C. and above.

5. The dissolvable alloy according to claim 1, wherein said dissolvable alloy is in the form of bars.

6. The dissolvable alloy according to claim 1, wherein said dissolvable alloy is used to make oil well tools and components.

7. The dissolvable alloy according to claim 6, wherein said dissolvable alloy is used to make disposable plugs for hydraulic testing.

* * * * *